US007704170B2

(12) United States Patent
Julian et al.

(10) Patent No.: US 7,704,170 B2
(45) Date of Patent: Apr. 27, 2010

(54) FOUR PIECE TABLE TENNIS TABLE HAVING A STABILIZED JOINT

(75) Inventors: David Julian, Evansville, IN (US); Scott Flowers, Newburgh, IN (US); Larry Wall, Evansville, IN (US)

(73) Assignee: SOP Services, Inc., Las Vegas, NV (US)

( * ) Notice: Subject to any disclaimer, the term of this patent is extended or adjusted under 35 U.S.C. 154(b) by 420 days.

(21) Appl. No.: 11/747,505

(22) Filed: May 11, 2007

(65) Prior Publication Data

US 2007/0265117 A1 Nov. 15, 2007

Related U.S. Application Data

(60) Provisional application No. 60/747,100, filed on May 12, 2006.

(51) Int. Cl.
*A63B 67/04* (2006.01)

(52) U.S. Cl. ..... 473/496

(58) Field of Classification Search ..... 473/496; 108/59, 64, 180, 185, 153.1, 154, 158.12; 411/457, 487, 493
See application file for complete search history.

(56) References Cited

U.S. PATENT DOCUMENTS

| | | | | |
|---|---|---|---|---|
| 653,851 | A * | 7/1900 | Smith | 108/64 |
| 737,455 | A | 8/1903 | Noble | |
| 834,461 | A | 10/1906 | Fair | |
| 952,408 | A | 3/1910 | Baugh | |
| 1,520,518 | A * | 12/1924 | Thomason | 108/64 |
| 1,822,217 | A * | 9/1931 | Hudson et al. | 403/286 |
| 1,919,780 | A * | 7/1933 | Fairbank | 52/584.1 |
| 1,995,173 | A * | 3/1935 | Ehle et al. | 411/459 |
| 2,398,603 | A * | 4/1946 | Soderberg | 411/457 |
| 2,569,077 | A | 9/1951 | Schneider | |
| 2,704,236 | A * | 3/1955 | Mahr | 108/64 |
| 2,840,431 | A * | 6/1958 | Budai | 312/111 |
| 2,867,807 | A * | 1/1959 | Anstett | 206/340 |
| 2,901,304 | A | 8/1959 | Fihe | |
| 3,091,487 | A * | 5/1963 | Gallagher et al. | 403/381 |
| 3,190,649 | A | 6/1965 | Heisler | |

(Continued)

FOREIGN PATENT DOCUMENTS

WO WO/ 99/02220 1/1999

OTHER PUBLICATIONS

SportCraft Table Tennis Table Assembly Instructions & Rules (Model 18/0855).

(Continued)

*Primary Examiner*—Raleigh W. Chiu
(74) *Attorney, Agent, or Firm*—Woodard, Emhardt, Moriarty, McNett & Henry LLP

(57) ABSTRACT

A multi-section table tennis table half comprises first and second table sections which abut to form a first table half. Each of the sections includes an upper surface for playing table tennis, an opposite lower surface an inner edge. The inner edges of the first and second sections abut to form a first table half joint. The vertical cross-section of the joint may be stepped, with each of the inner edges being stepped and thereby including a horizontal section positioned between two vertical sections. The table half may further include a fastener spanning the abutment between the sections to secure the connection of the sections.

16 Claims, 7 Drawing Sheets

U.S. PATENT DOCUMENTS

| | | | | | |
|---|---|---|---|---|---|
| 3,229,790 | A | | 1/1966 | Shayne | |
| 3,267,885 | A | | 8/1966 | Shore | |
| 3,318,269 | A | | 5/1967 | Kinn | |
| 3,342,149 | A | | 9/1967 | Kruissink | |
| 3,503,525 | A | | 3/1970 | Loebner | |
| 3,525,492 | A | | 8/1970 | Friedman et al. | |
| 3,661,100 | A | | 5/1972 | Tennant | |
| 3,820,477 | A | * | 6/1974 | Griffin | 108/89 |
| 3,823,938 | A | | 7/1974 | Unno | |
| 3,827,376 | A | | 8/1974 | Solomon | |
| 3,830,495 | A | | 8/1974 | Hill | |
| 3,866,913 | A | * | 2/1975 | Zimmers et al. | 473/435 |
| 3,969,975 | A | * | 7/1976 | Krol | 411/456 |
| 3,977,528 | A | | 8/1976 | Berger | |
| 4,016,819 | A | | 4/1977 | Cowling | |
| 4,067,266 | A | | 1/1978 | Lafargue | |
| 4,327,650 | A | | 5/1982 | Bue | |
| 4,409,906 | A | * | 10/1983 | Alneng | 514/356 |
| 4,458,387 | A | * | 7/1984 | Pearson | 24/101 B |
| 4,469,029 | A | | 9/1984 | Ramond | |
| 4,489,661 | A | | 12/1984 | Fitzgerald | |
| 4,591,289 | A | | 5/1986 | Vickers et al. | |
| 4,665,836 | A | * | 5/1987 | Burr | 108/64 |
| 4,763,321 | A | | 8/1988 | Calvignac et al. | |
| 4,911,085 | A | | 3/1990 | Pencoske | |
| D308,922 | S | | 7/1990 | Ng et al. | |
| 5,253,932 | A | * | 10/1993 | Nesovic | 312/140.3 |
| 5,560,302 | A | | 10/1996 | Diffrient et al. | |
| 5,595,427 | A | * | 1/1997 | Peters et al. | 312/140.4 |
| D378,635 | S | | 4/1997 | Studer et al. | |
| 5,816,957 | A | | 10/1998 | Dadbech | |
| 5,833,559 | A | * | 11/1998 | Appelbaum et al. | 473/496 |
| 6,041,721 | A | | 3/2000 | Weston | |
| 6,299,378 | B1 | * | 10/2001 | Griffith | 403/293 |
| 6,986,722 | B2 | * | 1/2006 | Dadbeh | 473/496 |
| 7,036,438 | B2 | * | 5/2006 | Okamoto et al. | 108/153.1 |
| 2003/0228944 | A1 | * | 12/2003 | Scruby | 473/496 |
| 2007/0265117 | A1 | * | 11/2007 | Julian et al. | 473/496 |

OTHER PUBLICATIONS

SportCraft Table Tennis Table Assembly Instructions and Rules, Model 27032, 27031 and 97032.
Challenger Indoor Table Tennis Table, Assembly Instructions and Owner's Manual, Model 6502, Aug. 13, 1999.
QuickServe Table Tennis Set, Packaging Slip, 6111.
Ready2Play Table Tennis Set, Information Sheet, 6019.

* cited by examiner

FOUR PIECE TABLE TENNIS TABLE HAVING A STABILIZED JOINT

REFERENCE TO RELATED APPLICATION

The present application claims the benefit of U.S. Provisional Patent Application Ser. No. 60/747,100 filed May 12, 2006 entitled FOUR PIECE TABLE TENNIS TABLE HAVING A STABILIZED JOINT which is hereby incorporated by reference in its entirety.

FIELD OF THE INVENTION

Certain embodiments of the present invention relate to table tennis table assemblies.

BACKGROUND OF THE INVENTION

Table tennis tables are known for recreation or competition. Due to their inherent size, it is impractical and/or unwieldy to ship them fully assembled. To accommodate smaller shipping sizes, the prior tables are typically unassembled. Further, assembly can take a number of hours and can require at least two people. Moreover, often a large number of parts are involved in table assembly. In many cases, parts such as bolts and nuts are missing or lost and customers cannot assemble a table and generally become frustrated. To assemble the table also requires a number of tools, some of which may not be available in the average household.

Alternately, some manufacturers ship fully or partially assembled tables to customers requiring substantially larger packaging and higher shipping costs. Large assembled units are difficult to deliver to dwellings with a recreation room in the basement or off an indirect hallway. At times, it is necessary to disassemble the table to take it to the place of intended use.

A table package which includes two one-piece table halves, requires a certain size which is difficult to ship to a retail location, which is difficult to display at a retail location, and which is difficult for a consumer to take home from a store. However, if a two-piece table half is used, i.e. table quarters, it is necessary to assemble them to form a table half. This typically forms a seam where the table sections are joined. In forming a seam, it is preferable to maintain an even playing surface and to not interfere with the visual impact of the playing surface.

An improved table tennis table assembly is desired.

SUMMARY

Figure 1:
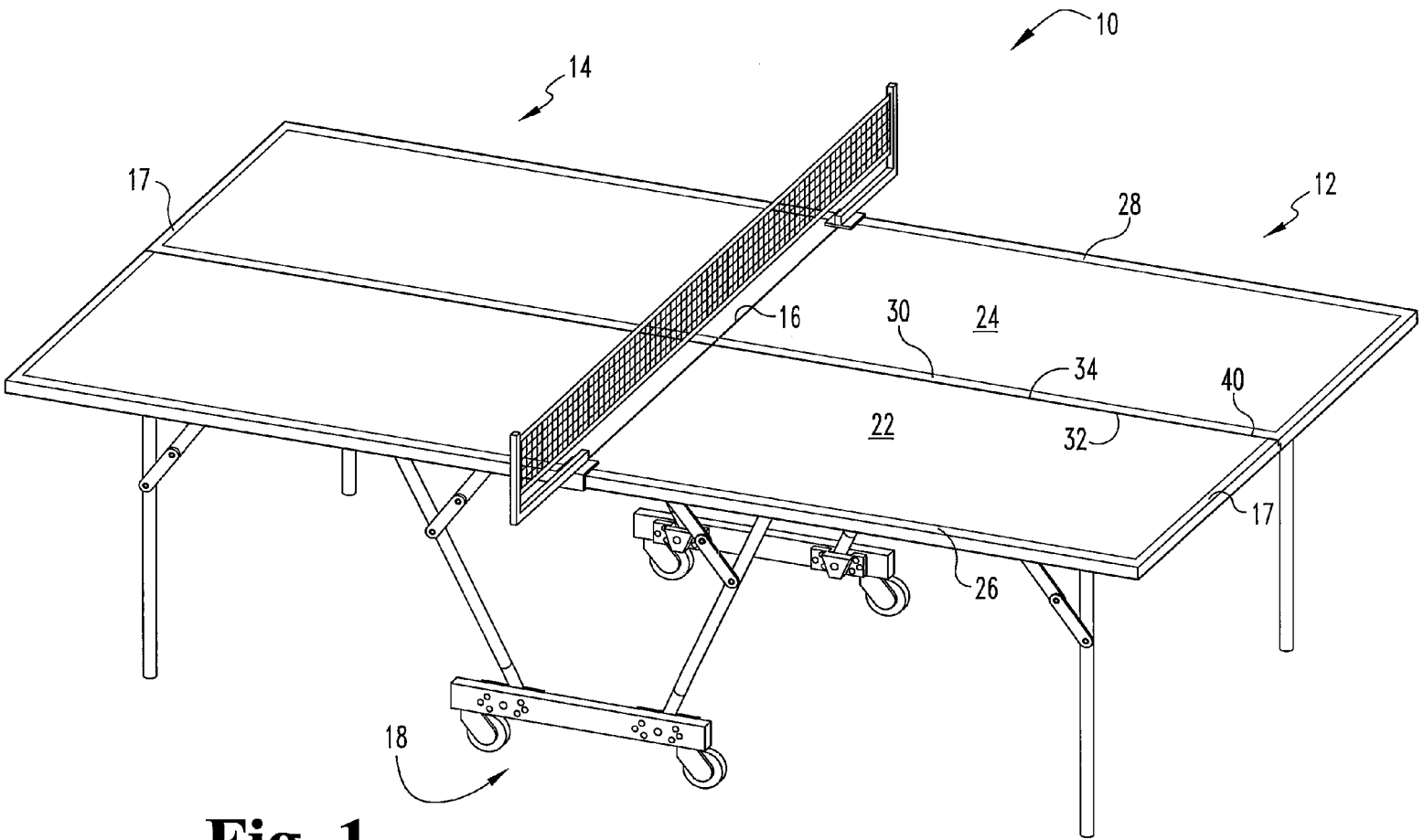
FIG. 1 is a perspective view of a table tennis table according to one preferred embodiment in the present invention.

In one embodiment, a multi-section table tennis table half comprises first and second table sections configured to abut to form a table tennis table half, each section having an upper surface for playing table tennis, an opposite lower surface and an inner edge. The inner edges of the sections abut to form a table half joint. Additionally, the vertical cross-section of the joint is stepped, with each of the inner edges being stepped and including at least one horizontal section positioned between at least two vertical sections.

In another embodiment, a multi-section table tennis table half comprises first and second table tennis table sections configured to abut to form a first table tennis table half. Each section includes an upper surface for playing table tennis and an opposite lower surface, and an inner edge extending between the upper and lower surfaces for contacting the other of the sections at a joint to create the table half. Each of the inner edges is non-vertical and the joint is a non-vertical engagement between the table sections, with the inner edges being complementary. Additionally, the table half may include at least one fastener spanning and supporting the abutment between the first and second table sections to secure the connection of the table sections.

In yet another embodiment, a multi-section table tennis table half comprises first and second table sections configured to abut to form a table tennis table half, each section having an upper surface for playing table tennis, a lower surface and an inner edge. The inner edges are configured to abut to form the table half, such that the abutting inner edges create a joint of the table half. The table half includes a length and a width, and a table tennis center stripe extending the length and arranged substantially halfway along the width. In such embodiments, the joint is aligned with an edge of the center stripe.

DESCRIPTION OF THE ILLUSTRATED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

The present invention provides a simplified multi-section table tennis table which requires a minimum of parts and when unpackaged is easy to assemble. The present invention provides a table tennis table that is transportable in a relatively small profile or configuration. The table preferably can be fully assembled without tools.

Certain preferred embodiments of the present invention include a table tennis table with table tennis halves each formed of two table quarter sections, secured in pairs with a stabilizing joint. In certain preferred embodiments, the joint is offset from center and may include a step or rabbet profile for enhanced stability. The offset joint is preferably adjacent the edge of a center stripe in the table tennis table half. In certain embodiments, one or more fasteners are placed to retain the joint between the table quarter sections in engagement.

FIG. 1 illustrates a perspective view of a table tennis table 10 having a first half 12 and a second half 14. Each table half has an outer end 17 and the halves meet in the middle along inner ends at a net location 16. A support system 18 supports the table halves in a playing configuration when assembled and in certain storage arrangements as well. The support system commonly includes exterior corner legs and a central carriage or legs attaching the first table half to the second table half. The legs and carriage may be foldable to allow the table halves to be rotated to an upright orientation for storage or movement. The legs or carriage may include castors or wheels.

For brevity, first table half 12 will be described and illustrated in detail. Second table half 14 includes substantially identical structure which, when assembled, is arranged in a symmetric orientation to first table half 12.

Directional references herein are intend for convenience only and are not intended to be limiting. For orientation, each table half is referred to as having two longitudinal side edges also referred to as outer edges, with inward referring to a direction toward the center of the table half. Each table half also includes an inner end adjacent the center net location 16 and an outer end 17. The playing surface defines a top or upward direction.

Figure 2:
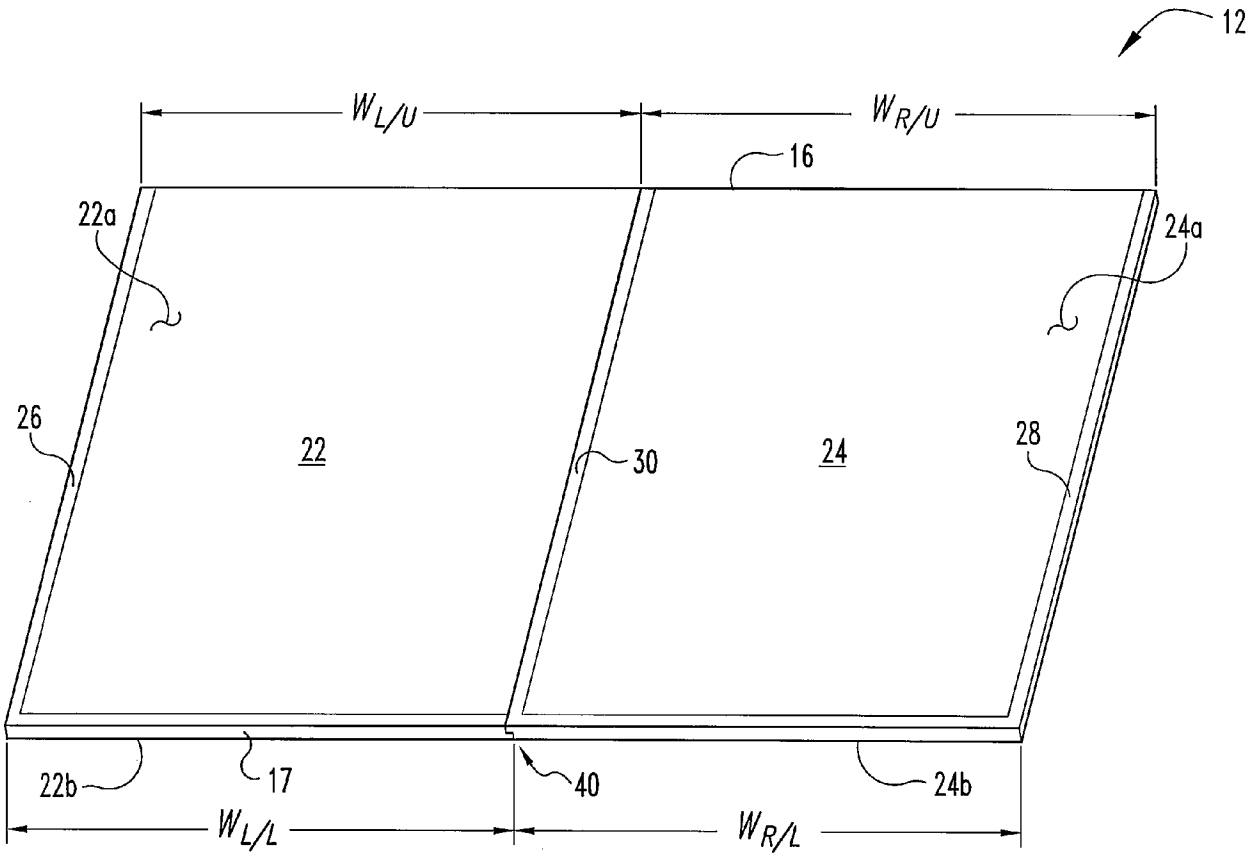
FIG. 2 is a perspective view of one table half of the embodiment FIG. 1.
Figure 3:
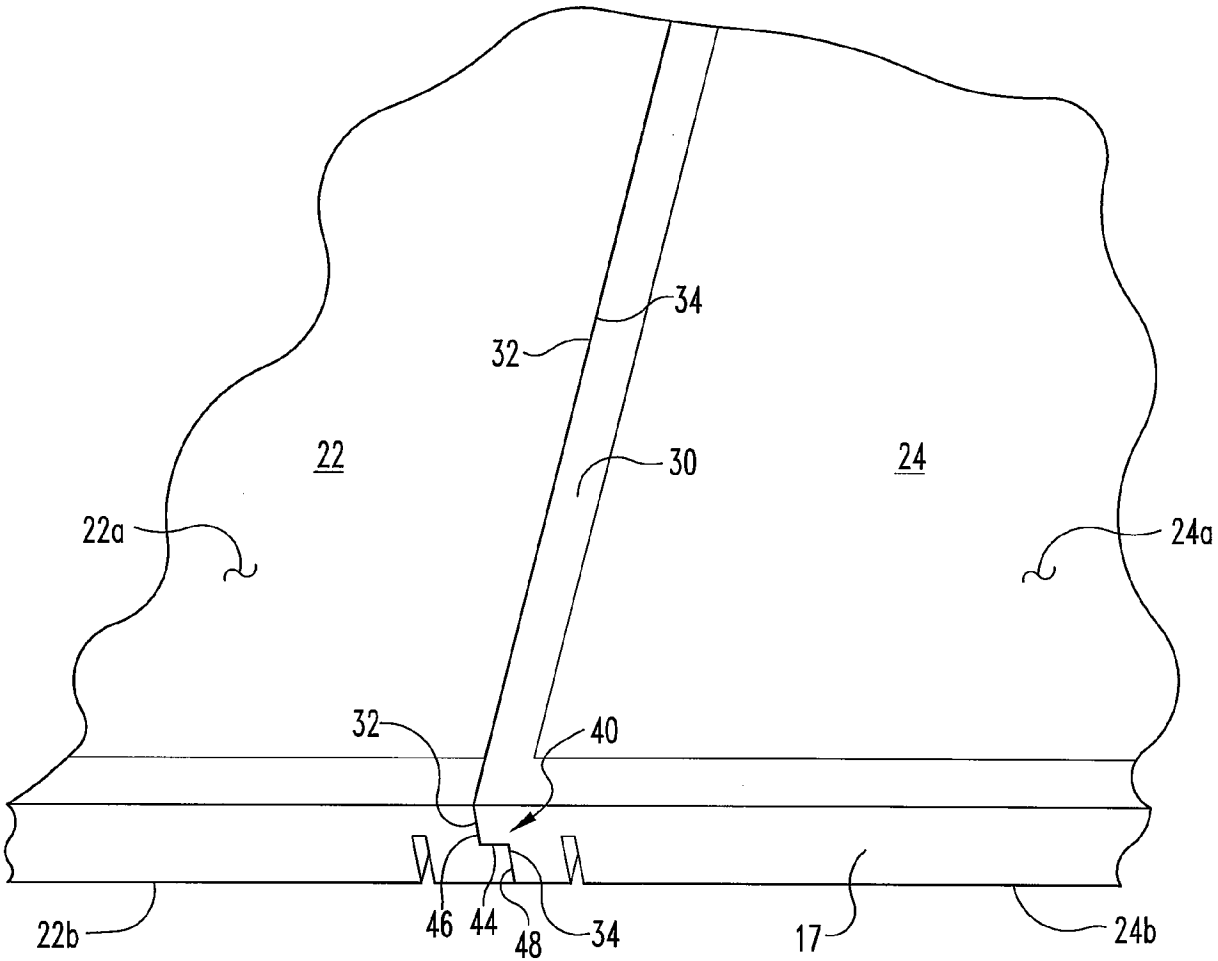
FIG. 3 is an enlarged perspective view of a joint portion of the table half of FIG. 2.

First table half 12 is illustrated in a perspective view in FIG. 2. Table half 12 includes a left hand quarter table section 22 and a right hand quarter table section 24. The two quarter sections meet at a joint 40 to form table half 12. The table sections include upper playing surfaces 22*a* and 24*a*, respectively, used when a table tennis game is played, and lower surfaces 22*b* and 24*b*, respectively. Quarter sections 22 and 24 include outer perimeter stripes 26 and 28 along their respective outer edges and an end stripe extending along the outer end 17. A central, longitudinal stripe 30 is arranged at a mid-point position between outer edge stripes 26 and 28.

Referring to FIGS. 1-4, table half 12 includes a stabilized central joint 40 between quarter table sections 22 and 24. Joint 40 is illustrated at the intersection of the inner edges 32 and 34 of table sections 22 and 24. As shown in FIG. 2, in certain preferred embodiments, joint 40 is offset from the center of table half 12, with the width $W_{R/U}$ of upper surface 24*a* of right hand section 24 slightly greater than the width $W_{L/U}$ of upper surface 22*a* of left hand section 22. In certain embodiments, this places the top seam of joint 40 adjacent to or forming an edge of center stripe 30.

Inner edges 32 and 34 of the table sections include complementary profiles arrangeable adjacent and abutting each other to form joint 40. In certain preferred embodiments, joint 40 is a rabbet or step joint extending along the longitudinal length of inner edges 32 and 34. As illustrated in enlarged detail in FIGS. 3 and 4, the step joint includes an upper vertical or rise portion 46, a middle horizontal or run portion 44, and a lower vertical or rise portion 48. Run portion 44 has a length defining an offset distance between upper portion 46 and lower portion 48. Preferably the step profile extends along the entire longitudinal length of inner edges 32 and 34. In such embodiments, widths $W_{L/U}$ and $W_{R/U}$ of upper surfaces 22*a* and 24*a*, respectively, are unequal to widths $W_{L/L}$ and $W_{R/L}$ of lower surfaces 22*b* and 24*b*, respectively.

Figure 4:
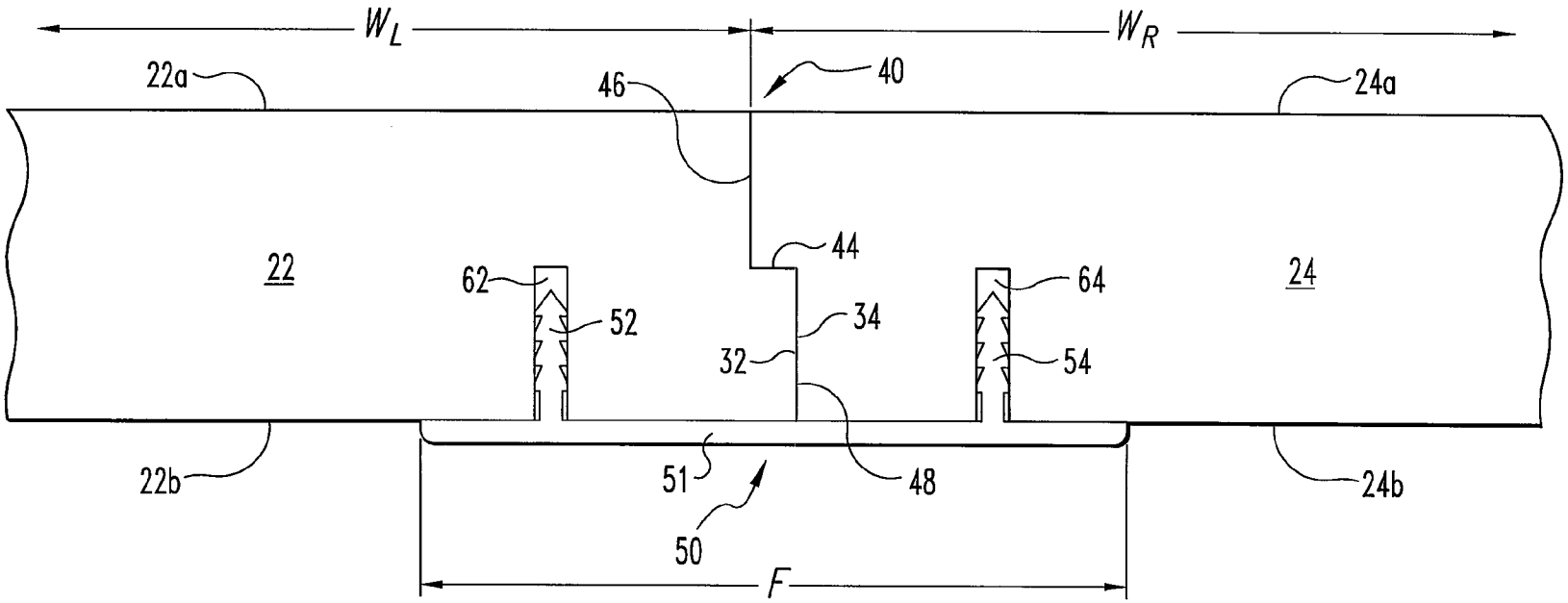
FIG. 4 is an end-on view of the joint portion of FIG. 3.
Figure 5:
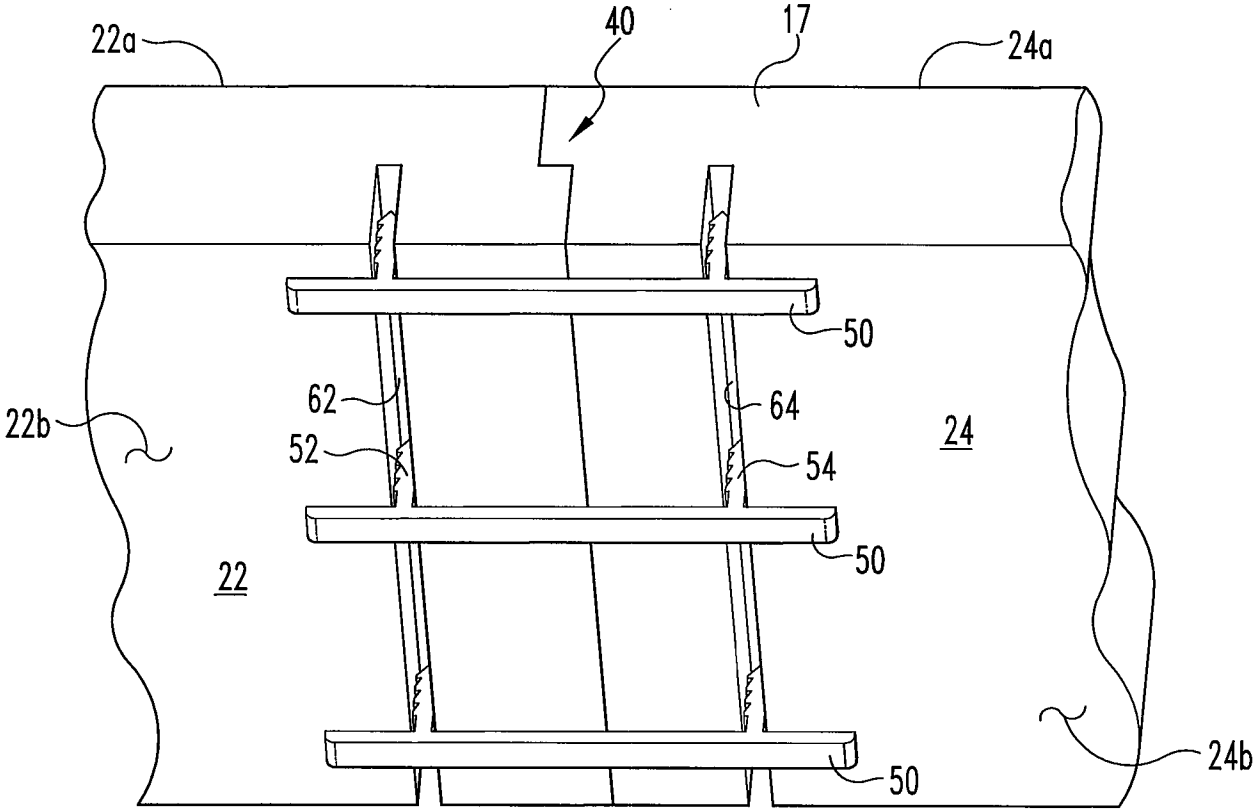
FIG. 5 is a perspective lower view of the table half of FIG. 2.
Figure 7:
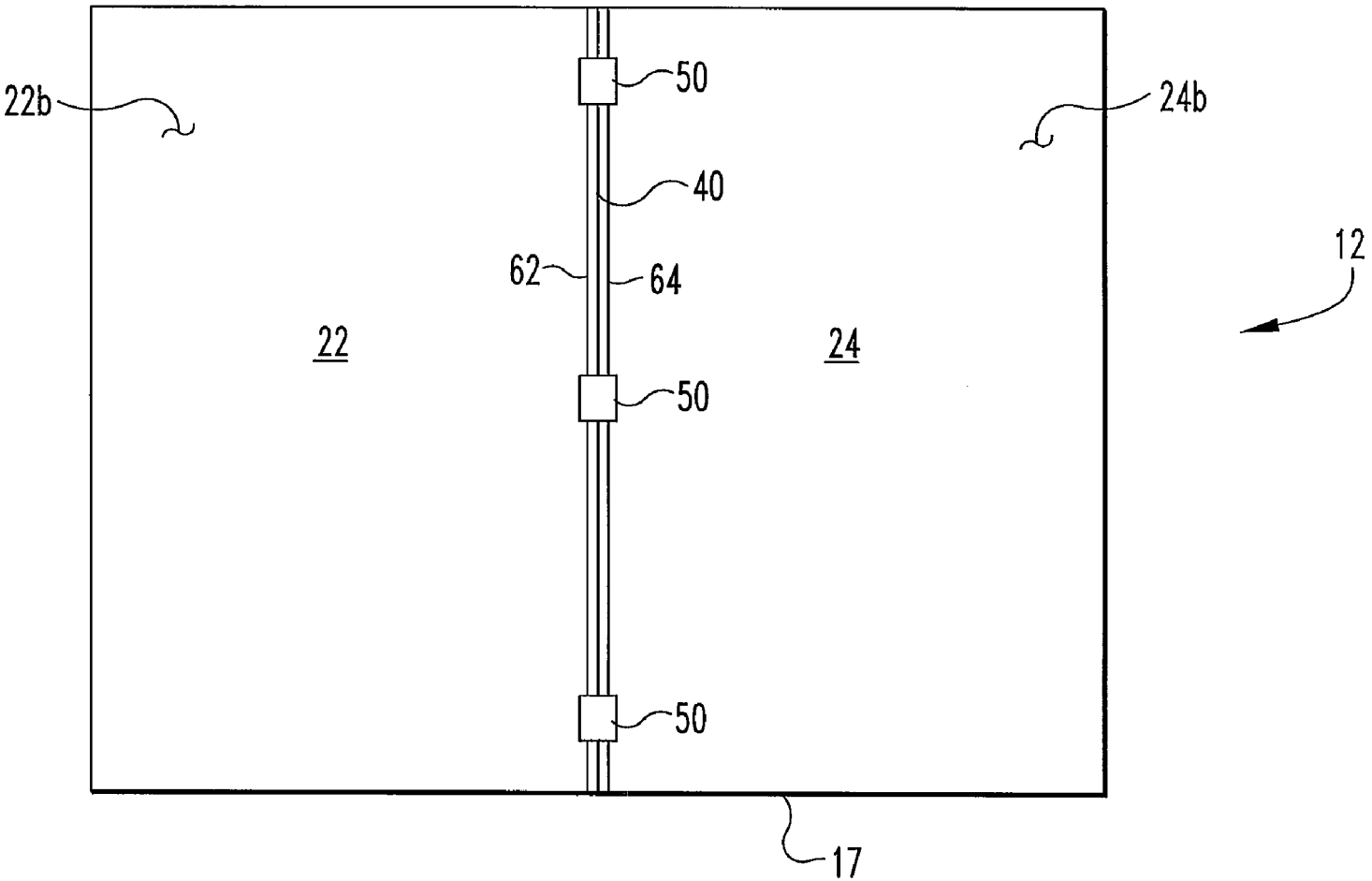
FIG. 7 is a lower view of the table half of FIG. 2.

FIGS. 4, 5 and 7 further illustrate fasteners used to retain the table sections together along joint 40 and to prevent disengagement from the joint. Fastener 50 includes a horizontal backing plate portion 51 having a left hand flange or fastener 52 and a right hand flange or fastener 54, with the fasteners 52 and 54 extending substantially perpendicular to plate portion 51. In the embodiment illustrated, fasteners 52 and 54 form a substantially vertical flange shape and include angled or slanted teeth to allow introduction of the fasteners into retaining openings yet inhibit removal.

In certain embodiments, the table sections include retaining openings in the lower surfaces thereof configured to receive the fastener flanges. As illustrated, left hand table section 22 defines a left retaining slot in lower surface 22*b* and right hand table section 24 defines a right retaining slot 64 in lower surface 24*b*, which respectively receive fastener flanges 52 and 54. Preferably the retaining slots 62 and 64 are substantially aligned about joint 40 and have a width cooperating with the fasteners to allow introduction of the flanges, yet which resists removal. The flange material and teeth are optionally compressible to facilitate placement.

As one embodiment, retaining slots 62 and 64 are illustrated as longitudinal grooves extending along the length of the table sections on the lower surfaces adjacent inner edges 32 and 34. The longitudinal length allows placement of one or more spaced fasteners 50 as desired. In other embodiments, the retaining openings in the lower surfaces of the table sections are pre-bored holes in pairs on opposing sides of the table half joint, with the fasteners including pegs or flanges to engage the pre-bored holes.

Figure 6:
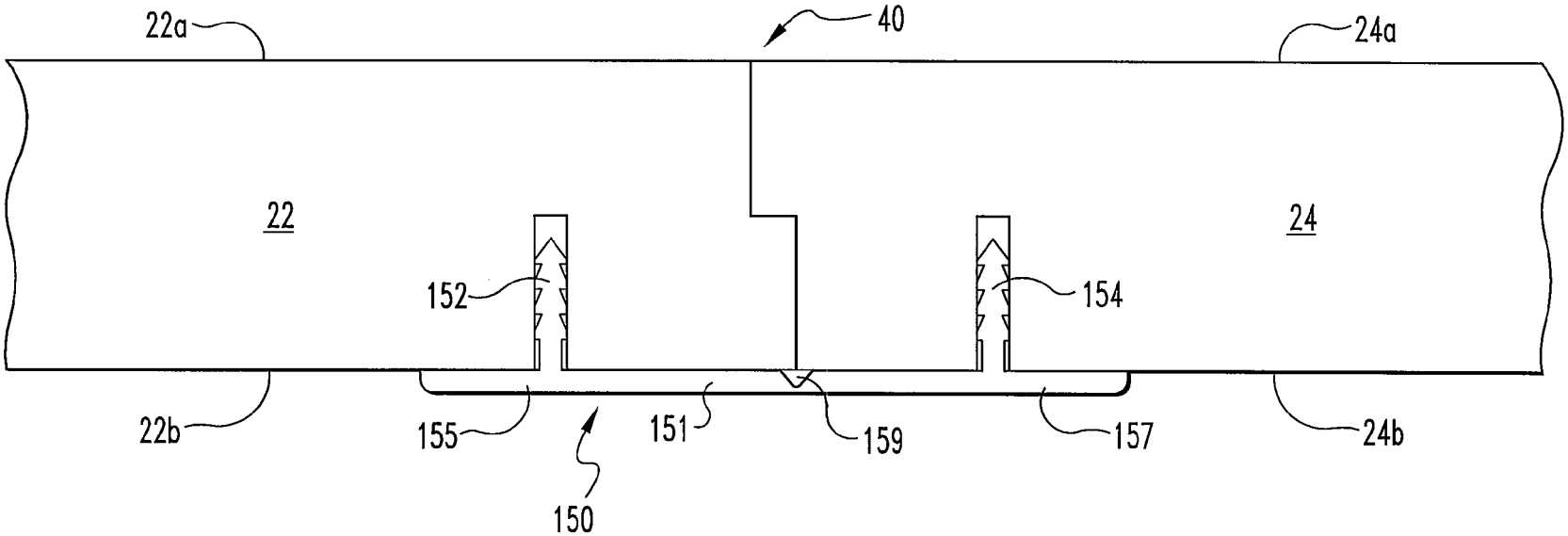
FIG. 6 is an end-on view of the joint portion according to an alternate preferred embodiment.

An alternate fastener 150 is illustrated in FIG. 6. Fastener plate 150 includes a plate portion 151 having two halves 155 and 157 separated by a defined thinner section forming a groove or living hinge 159. Hinge 159 is preferably a one-way hinge allowing the table sections to be rotated from a folded configuration, where the table sections are initially stacked back-to-back, by raising the outer edges until the table sections reach a horizontal configuration and the inner edges horizontally abut to form joint 40, after which the hinge resists further rotation and/or downward relative movement of joint 40. In the illustrated embodiment, fastener 150 includes flanges 152 and 154, similar in design and operation to fastener flanges 52 and 54 described above.

In certain preferred embodiments, the proportions and stripes of table 10 are sized to be consistent with regulation dimensions sponsored by USA Table Tennis and the International Table Tennis Federation. For purposes of illustration, example dimensions are given as follows, although it will be understood that dimensions can be varied by those of skill in the art without departing from the spirit of the present invention. In the example of table 10, the width of the table and table halves is 60 inches (1.525 m) with the longitudinal length of each half being 54 inches respectively (total of 2.74 m) at a height of 30 inches (76 cm). The table sections are illustrated with a thickness of ¾ of an inch (1.9 cm). The perimeter stripes have a width of 25/32 (2 cm). The central stripe has width of 3 mm for regulation play, yet commonly has a width of ⅜ of an inch (9.5 mm) for recreational play. Options to apply the stripes include screen printing or tape, although printing is preferred.

In the example rabbet or step joint, joint 40 is offset from center with the upper surfaces 22*a* and 24*a* of the table sections having a left hand width $W_{L/U}$ of 29 13/16 inches (75.72 cm) and a right hand width $W_{R/U}$ of 30 3/16 inches (76.68 cm). In the example rabbet or step joint, upper rise 46 has a height of 9/32 of an inch (6.8 mm), lower rise 48 has a height of 15/32 of an inch (12.2 mm), and offset middle portion 44 has a length of 3/32 of an inch (2.6 mm). An example of fastener 50 has a width F of 1¾ inches (4.45 cm) and a longitudinal length of 3 inches (7.62 cm), and is illustrated with three fasteners 50 spaced along the length of joint 40 in each table half at centered separations of 21¾ inches (55.24 cm) and 5¼ inches (13.34 cm) from each end.

In a disassembled state, the components of the table allows quarter sections of the table to be stacked in a package or box having an interior cross-section substantially sized to snugly accommodate the cross-section of the largest quarter table section and, if desired, packing material. In certain preferred embodiments, the four quarter sections, a support frame and legs, and optionally game-playing equipment can be packaged in a box which is conveniently sized for shipment to a retail location, which can be displayed at the location, and which can be taken home by a consumer in a standard car, pick-up truck, van or SUV. Compact arrangement also can facilitate international transport by maximizing efficient packing of the boxes in a shipping container.

When the table is ready to be assembled, for example at a consumer's home, the package is opened and two quarter sections are placed, typically playing face down, on a support surface with the inner edges aligned and pushed together along joint 40. Fasteners 50 are placed across the joint and pressed into engagement with respective slots or holes using direct manual pressure or optionally an impact tool such as a hammer. When the table quarter sections are joined together, the table half can be arranged upside down or right side up as desired while being mounted to support hardware such as legs and a center connection such as a carriage. The process is then repeated for the second table half.

When completely assembled in a playing position, the upper faces of the table halves are oriented upward with a net positioned along a central line perpendicular to the longitudinal length. In this arrangement, preferably the upper seam of joint 40 is offset adjacent an edge of the center stripe 30 forming a less noticeable line which does not interrupt a solid color such as the middle of a playing area panel or the middle of the center stripe. In certain embodiments, the rabbet or step joint provides a stabilized joint minimizing vertical sliding of the table quarter sections relative to each other. Fastener plate 50 and fastener flanges 52 and 54 primarily assist in holding the joint in an engaged orientation and may also minimize downward flexing, for example by resisting separation along the lower section 48 of the joint.

In one preferred embodiment, when packaged, the table quarter section pairs are placed with the upper playing surfaces facing each other either in direct contact or with a separating material to minimize potential damage during transit. In an alternate preferred embodiment, for example using fastener 150 of FIG. 6, a pair of quarter table sections are folded to a parallel arrangement with the lower surfaces adjacent each other and the playing surfaces facing outward, allowing the table half to be removed from the package and then unfolded to a flat configuration using the one-way hinge effect of fastener 150. In this embodiment, fastener 150 is assembled to the table sections at the factory and on-site fastener assembly is unnecessary.

It is contemplated that joint 40 may be formed in different embodiments with a variety of non-vertical, complementary profiles of the inner edges. In other words, it is contemplated that sections 22 and 24 may include vertical cross-sections of varying width from the upper surface to the lower surface of the sections. As examples, joint 40 could include non-linear configurations, non-right angle corners or more than one rise and run portion, for example with a tongue and groove or a mortise and tenon type joint. In another option, the joint can interlock with one portion pressed or rotated to snap the joint into a locking engagement. Optionally the joint surfaces are roughened or have teeth which engage to lock the joint. In such preferred and alternative embodiments, it is contemplated that the width of each section at at least one point along the corresponding joint is unequal to the corresponding widths of the upper and lower surfaces.

In other embodiments, fastener 50 can be secured to the quarter sections using removable or permanent fasteners such as nails, screws, bolts and nested nuts, rivets, staples, or adhesive to name a few. In a further alternate embodiment, latches can be used to hold the quarter table sections together. Preferably, the fasteners do not protrude into the playing surface. Alternate embodiments to fastener 150 include one-way hinges which allow the quarter table sections to be unfolded to a horizontal orientation with the hinge at substantially a 180° open arrangement, yet which are inoperable beyond an 180° angle.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A multi-section table tennis table half, comprising:

first and second corresponding table sections configured to abut to form a table tennis table half, each section having an upper surface for playing table tennis, an opposite lower surface and an inner edge, wherein said inner edges of said first and second sections abut to form a table half joint;

at least one fastener spanning the abutment between said first and second sections to secure the connection of said sections wherein said fastener includes a one-way hinge section adjacent said table half joint such that said fastener allows said table sections to be rotated between a substantially horizontal game-playing configuration and a folded configuration in which said lower surfaces substantially face each other; and wherein the vertical cross-section of said joint is stepped, each of said inner edges being stepped and including at least one horizontal section positioned between at least two vertical sections.

2. The table half of claim 1, wherein said table half includes a length and a width, the table half including a center width extending the length of said table half substantially halfway along the width, wherein said joint at said upper surfaces is offset from the center width.

3. The table half of claim 2, wherein said fastener includes a plate section and two flanges extending substantially perpendicular to said plate section, wherein each of said lower surfaces includes at least one retaining opening adjacent said inner edge configured to receive one of said flanges.

4. The table half of claim 3, wherein each of said flanges includes angled teeth disposed thereon configured to allow introduction and inhibit removal of said flanges in said corresponding retaining openings.

5. The table half of claim 3, wherein each of said retaining openings is a slot extending substantially along the length of said corresponding section adjacent said corresponding inner edge.

6. The table half of claim 3, wherein each of said lower surfaces includes at least two of said retaining openings, said retaining openings being holes in said lower surfaces, said retaining openings in said first and second table sections being substantially aligned as pairs on opposite sides of said first table half joint.

7. A multi-section table tennis table half, comprising:

first and second table tennis table sections configured to abut to form a first table tennis table half, wherein each of said sections includes an upper surface for playing table tennis and an opposite lower surface, wherein each of said sections includes an inner edge extending between said respective upper and lower surfaces for contacting the other of said sections at a joint to create said table half;

wherein each of said inner edges is non-vertical and said joint is a non-vertical engagement between said table sections, said inner edges being complementary; and at least one fastener spanning and supporting the abutment between said first and second table sections to secure the connection of said table sections wherein said fastener includes a one-way hinge section adjacent said table half joint such that said fastener allows said table sections to be rotated between a substantially horizontal game-playing configuration and a folded configuration in which said lower surfaces substantially face each other.

8. The table half of claim 7, wherein said table half includes a length and a width, the table half including a center width extending the length of said table half substantially halfway along the width, wherein said joint at said upper surfaces is offset from the center width.

9. The table half of claim 7, wherein each of said inner edges is stepped.

10. The table half of claim 7, wherein each of said lower surfaces includes a retaining slot adjacent said corresponding inner edge.

11. The table half of claim 10, wherein said fastener includes a plate section and two flanges extending substantially perpendicular to said plate section, each of said retaining slots being configured to receive one of said flanges therein.

12. A multi-section table tennis table half, comprising:

first and second table sections configured to abut to form a table tennis table half, each section having an upper surface for playing table tennis, a lower surface and an inner edge, wherein said inner edges are configured to abut to form said table half, said abutting inner edges creating a joint of said table half;

wherein said table half includes a length and a width, wherein said table half includes a table tennis center stripe extending the length of said table half and arranged substantially halfway along the width of said table half, wherein said joint is aligned with an edge of said center stripe; and, at least one fastener spanning and supporting the abutment between said first and second table sections to secure the connection of said table sections wherein said fastener includes a one-way hinge section adjacent said table half joint such that said fastener allows said table sections to be rotated between a substantially horizontal game-playing configuration and a folded configuration in which said lower surfaces substantially face each other.

13. The game table of claim 12, wherein each of said inner edges is stepped and includes at least one horizontal section positioned between at least two vertical sections.

14. The game table of claim 12, wherein each of said inner edges is non-vertical, said inner edges being complementary.

15. The game table of claim 12, wherein said fastener includes a plate section and two flanges extending substantially perpendicular to said plate section, and wherein each of said lower surfaces includes a retaining slot extending the length of said section adjacent said inner edge configured to receive one of said flanges.

16. The game table of claim 15, wherein each of said flanges includes angled teeth disposed thereon configured to allow introduction of said flanges in said corresponding retaining slot and inhibit removal of said flanges from said corresponding retaining slot.

* * * * *